US005471291A

United States Patent [19]

Janes et al.

[11] Patent Number: 5,471,291

[45] Date of Patent: Nov. 28, 1995

[54] COLOR IMAGING WITH CONTACT TRANSFER HEATING STATION

[75] Inventors: Todd L. Janes; Alexander D. Meade; Ashok Murthy; Pramod K. Sharma; Peter E. Wallin, all of Lexington, Ky.

[73] Assignee: Lexmark International, Inc., Greenwich, Conn.

[21] Appl. No.: 251,429

[22] Filed: May 31, 1994

[51] Int. Cl.[6] ..... G03G 21/00

[52] U.S. Cl. ..... 355/326 R; 118/659; 355/256; 355/277

[58] Field of Search ..... 355/256, 326 R, 355/327, 328, 326 M, 245, 274, 277, 271–273, 279; 118/659, 660, 661, 645, 644

[56] References Cited

U.S. PATENT DOCUMENTS

| | | | |
|---|---|---|---|
| 4,199,626 | 4/1980 | Stryjewski et al. | 427/444 |
| 4,453,820 | 6/1984 | Suzuki . | |
| 4,796,048 | 1/1989 | Bean | 355/271 |
| 4,935,788 | 6/1990 | Fantuzzo et al. | 355/326 R |
| 4,992,833 | 2/1991 | Derimiggio | 355/282 |
| 5,136,334 | 8/1992 | Camis et al. | 355/256 |
| 5,158,846 | 10/1992 | Bujese | 430/47 |
| 5,247,334 | 9/1993 | Miyakawa et al. | 355/271 |
| 5,253,021 | 10/1993 | Aslam et al. | 355/271 |
| 5,335,054 | 8/1994 | Landa et al. | 355/279 |
| 5,362,833 | 11/1994 | Chen et al. | 528/25 |

FOREIGN PATENT DOCUMENTS

| | | | |
|---|---|---|---|
| 4050968 | 2/1992 | Japan | 355/256 |

*Primary Examiner*—A. T. Grimley
*Assistant Examiner*—T. A. Dang
*Attorney, Agent, or Firm*—John A. Brady

[57] ABSTRACT

In imaging apparatus (1) a contact heater (9) applies heat and electrical bias to a toner image on an intermediate accumulator (5). The bias is of polarity to repel the toner. The toner image is coalesced such that additional heating may be reduced or eliminated at the transfer to paper (7) by pressure roller (11).

10 Claims, 1 Drawing Sheet

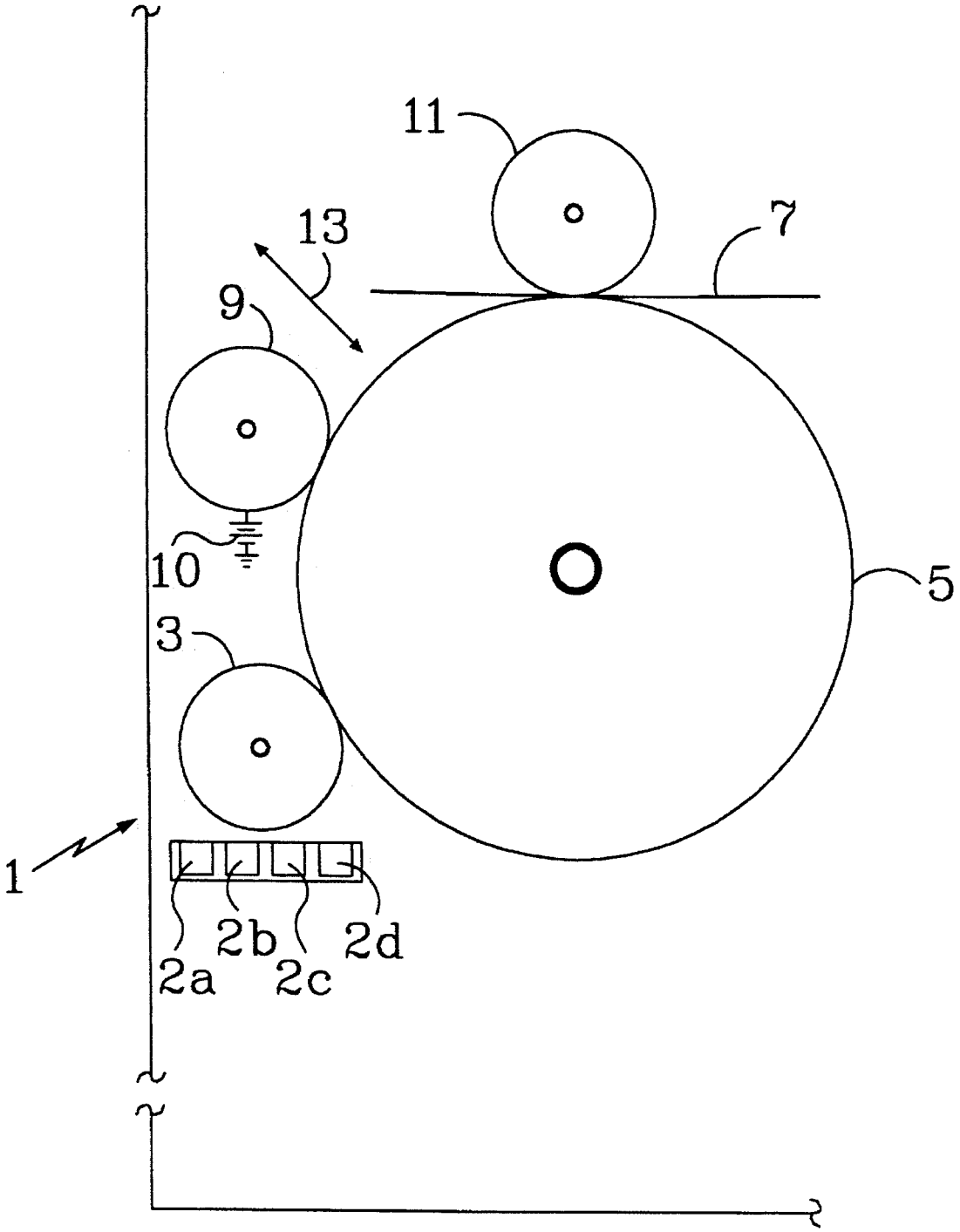
11
13
7
9
10
5
3
1
2a
2b
2c
2d

COLOR IMAGING WITH CONTACT TRANSFER HEATING STATION

TECHNICAL FIELD

This invention relates to electrophotographic imaging employing transfer of toner images from an intermediate member with preliminary heating of that member.

BACKGROUND OF THE INVENTION

In color imaging separate images in three primary colors and, generally, also a separate image in black are combined on a single substrate in registration. This invention is directed to such imaging systems in which toner images are combined on an intermediate member prior to being transferred as a unit to paper or other final substrate. Such transfer previously has been accomplished by heating at the transfer station and by preheating immediately prior to the transfer station. Heating at the transfer station is effective provided the high temperature levels employed are acceptable with the overall design of the printer and consistent operation can be achieved. Although materials are known, such as silicone rubbers, which function extremely well as an intermediate surface, the ability of the material to release toner degrades with usage to such a degree that the quality of the image is noticeably affected. As the intermediate surface must be large enough to contain the entire image (in the case of a drum, a circumference of at least 14 inches is typically required), the machine component is necessarily bulky and expensive, and therefore not readily designed as a replaceable supply item.

In addition to possessing excellent release properties, the intermediate surface must also be compatible with electrostatic transfer of multiple layers of toner from a photoconductor. The electrical properties constraints imposed by this requirement further limit the choices of material. No material is known which meets all of the transfer requirements without preheating and is durable enough to withstand more than 100,000 image releases to paper.

The temperature requirements for transfer of toner from the intermediate surface to paper are such that the transfer roller temperature must be in excess of 160 degrees C. to effect 100 percent transfer of toner to paper from the best known intermediate drum release materials. As the release properties of materials degrade with usage and with contact against paper, the transfer roller temperature requirements increase. As a result of the high transfer roller temperature, the temperature of the intermediate transfer surface increases during long printing runs, in particular when only one primary color is used and the transfer roller is engaged for a large proportion of the operating cycle of the imaging device. Without elaborate cooling schemes, the temperature of the photoconductor, due to continuous rolling contact against the intermediate surface, is increased beyond the range of acceptable operation. This condition is exaggerated in the case of a machine operating in a hot environment. In addition, it is necessary to prevent excessive contact between the hot transfer roller and the intermediate surface, not only to prevent overheating of the photoconductor, but to prevent excessive vaporization of the process carrier fluid, such as mineral oil, of a liquid toner. This constraint precludes the use of print media substantially narrower than the transfer roller width, effectively limiting the imaging operation to one width of paper.

Heating prior to the transfer tends to coalesce the toned image and reduce or eliminate the need to heat at actual transfer, but effective preheating of color images has not been previously accomplished. This invention accomplishes such preheating, thereby avoiding the foregoing constraints. Preheating is shown in the following prior art references, but none employ contact heating with electrical bias as does this invention. Contact heating is employed in U.S. Pat. No. 5,247,334 to Miyakawa et al. The following employ radiant heating as preheating for transfer: U.S. Pat. Nos. 5,158,846 to Bujese, No. 4,992,833 to Derimiggio and No. 4,453,820 to Suzuki.

DISCLOSURE OF THE INVENTION

In accordance with this invention an imaging apparatus in which images are accumulated on an intermediate member employs contact heating with electrical bias on the contact member the same polarity as the toner. In order to maintain image integrity, the electrical bias is essential. The contact heating is consistent because it is not influenced by the mix of toner colors in each image, as is radiant heating.

BRIEF DESCRIPTION OF THE DRAWING

The details of this invention will be described in connection with the accompany drawing illustrative of an imaging apparatus in accordance with this invention.

BEST MODE FOR CARRYING OUT THE INVENTION

A typical liquid-toner color electrophotographic apparatus is shown in the drawing. Although this invention is disclosed in liquid color electrophotography apparatus 1, the principles can be applied to systems employing dry, or powder, toner. This invention may also be applied to a monochrome process. Likewise, the imaging means may be digital (e.g., laser or light emitting diode printhead) or analog as in a conventional photocopying machine. This invention may employ the photoconductor 3 or use ionography or other means of producing a toned electrostatic image.

Toners of the primary process colors (cyan, magenta, yellow and black) are sequentially introduced to a charged and laser-imaged photoconductor 3 by means of movable developer stations 2*a*, 2*b*, 2*c*, and 2*d*. As each primary color is developed onto the imaged photoconductor 3, it is subsequently transferred to and accumulated on an intermediate surface 5, such as a roller or drum, which is large enough to contain the entire image. Following accumulation of all four image layers on the intermediate drum 5 surface, the image is heated as will be described and transferred to paper or other print media 7.

Specifically a heating roller 9 contacts the accumulator drum 5 just prior to transfer to paper 7 to prepare the toner image on drum 5 to transfer without additional heat at the transfer station. As shown illustratively as 10, heating roller 9 is biased electrically with a polarity the same as that of the toner on drum 5, specifically in this embodiment to 1500 volts negative to intermediate drum 5 (drum 5 being electrically biased positively, as is conventional, to attract the toned image from photoconductor).

The heat and electrical bias from roller 9 converts the toned image on drum 5 from discrete particles to coherent film. Following conversion of the image on the intermediate surface 5, paper 7 is introduced to the drum 5 surface and pressed into intimate contact with the drum 5 surface by the action of a movable pressure roller 11, which preferably is moderately heated and is pressed against the nonimage side of the print medium 7 with sufficient force to ensure intimate contact between the print media 7 and the image film on surface 5. As is conventional, roller 11 is supplied with an electrical potential of sign and magnitude such that the toner image is attracted from the intermediate surface 5 to the paper 7. Once transferred to print media 7, the image is fused by means, which may be entirely conventional, not shown.

In accordance with this invention, the transfer of toner from the intermediate surface 5 to the final substrate 7 is greatly simplified by the toned image being first brought momentarily to a temperature at which the toner particles melt and form a thin film. In doing so, heating of the accumulator drum 5 surface is avoided. Heating roller 9 is moveable by a solenoid or the like, suggested illustratively as 13, and is brought into contact with the toned image just prior to transfer of the toned image to paper 7. In the case of a full color image, the heating roller 9 is brought into contact with the image after accumulation of the final color plane. The heating roller 9 pressure against the accumulator 5 surface is just sufficient to maintain uniform contact across the width of the substrate 7, while the electrical bias on heating roller 9 repels the electrically charged toner. The heating roller is heated (by an internal radiant lamp or other means, not shown) to a surface temperature between 85 degrees and 120 degrees C., depending on the exact composition of the toner and on the temperature of the accumulator 5 surface, which in this specific embodiment is maintained at 50 degrees C. to prevent heat damage to the photoconductor 3.

By momentarily raising the temperature of the toner above the point at which the transformation of toner from particles to film occurs, the subsequent transfer to paper is made quite straightforward. In particular, once the image has been transformed, heat generally is no longer necessary to effect transfer to paper. Transfer to paper or other substrate 7 generally may be effected by action of electrical bias on a pressure roller 11 with mechanical pressure. The pressure roller 11 does not require a heat source, and can be operated at room temperature.

In addition to eliminating the need for heating the paper to effect transfer, the transformation of the toner also relaxes the release requirements for the material used as an accumulator 5 surface. Since the toner image is completely cohesive after transformation by heat and bias from roller 9, it is not necessary that the accumulator 5 surface be selected to release all individual toner particles easily. It is only necessary that the electrostatic force holding the transformed image to the paper 7 be greater than the attractive forces holding the transformed image to the accumulator 5 surface. In particular, it has been found that materials otherwise known to be poor release surfaces will effect 100% transfer once the toner is transformed to a filmed state. By transforming the toner to a filmed state, the choice of accumulator 5 surfaces can be dictated by other requirements, such a long service life and facilitating four layer transfer from a photoconductor.

Design requirements for excellent heating roller 9 performance include: good transfer of heat from the roller 9 surface to the image on the accumulator 5 surface, electrical properties compatible with application of a field to the toner image such that the toner is forced toward the accumulator 5 surface while not causing Paschen breakdown of air and subsequent attraction of toner to the heating roller 9 surface, and a surface of heating roller 9 with long usable life.

A typical film roller 9 might be constructed of an aluminum core, coated with a tough polymer capable of withstanding 85 degrees to 120 degrees C. temperature. The electrical resistivity of the coating may be less than 1E11 (ten to the eleventh power) ohm-cm. Typical coatings include low surface energy resins.

The most economical material which best meets all of the requirement is polytetrafluroethylene resin with a conductive filler. Many other material families such as silicone and polyurethane were considered. Polyurethane has a high surface energy (50 dynes/cm) which promotes offset of toner to the film roll. Furthermore, polyurethane cannot withstand the high temperatures of 85 C. to 120 C. required for the film roll to function. These two considerations make polyurethane an undesirable choice. The other possible candidate, silicone, has some drawbacks as well. Silicone has many of the properties that will allow the film roll to function. It has low surface energy (20 dynes/cm), it can be made thermally and electrically conductive, and it has very high temperature resistance. However, when silicon is exposed to the heavy mineral oil carrier fluid it swells 11% to 70% by weight. This swelling significantly reduces the already marginal physical properties (ultimate tensile strength, modules, tear strength, abrasion resistance). For this reason a fluorocarbon resin or elastomer should be chosen.

Fluorocarbon resins and elastomers have very low surface energy (18 dynes/cm). They can withstand temperature in excess of 200 C. They do not swell in the presence of heavy mineral oil and have very good abrasion resistance. Inherently these materials are electrically and thermally insulative. Thus they need to be filled with carbon black or metal powder to increase the electrical and thermal conductivity. The preferred embodiment of this material class for use in the film roll application is a conductive 1E5 (ten to the fifth power) ohm-cm Teflon (trademark) formulation from Dupont. This is a three coating system with product numbers 855-001, 855-002, 855-103 which correspond to the primer, midcoating, and top release coating. This particular system is polytetrafluroethylene fluorocarbon resin that uses carbon black to achieve the correct electrical resistivity and thermal conductivity. It is coated and polished to a final thickness of 30 um over aluminum or steel.

Another embodiment of this invention is a solution dip coated Viton (trademark) fluorocarbon elastomer, from Dupont, filled with 10% aluminum powder or carbon black and dissolved to 30% solids in methylethylketone then dip or spray coated. Still another embodiment would be a carbon black filled perfluoroalkoxy resin sleeve that is heat shrinkable over a steel or aluminum core. The sleeve must be less than 50 um in thickness.

The film roll can be made to function with polyurethane, silicon, or fluorocarbon. However, for lifetime durability and maximum efficiency of filming toner (i.e. filming without offset or damaging to the image, and at the lowest temperatures possible), a thin coating (less than 50 um) of fluorocarbon resin or elastomer that has been modified with carbon black or metal powder to have the correct electrical and thermal conductivity is the best choice of material.

Data to support the claim that conductive Teflon fluorocarbon is the preferred material has been provided. This data shows the voltage bias window for no squash (flattening) or offset of images. To contrast, data for a non-conductive silicone has also been provided. Silicon, like conductive Teflon fluorocarbon, has low surface energy and thus has a large bias window for no offset. However, because it is electrically insulative the bias window for no squash with silicone is very small and at high biases which do not over-lap with the biases required for no offset. If this silicone were filled with carbon black or a metal powder to make it conductive it would function similarly to the conductive Teflon fluorocarbon material, but would still have an abrasion resistance limitation.

We claim:

1. An imaging apparatus comprising an electrostatically chargeable roller, means to tone said chargeable roller in patterns of images, an intermediate transfer member to receive said toned images, said intermediate transfer member accumulating at least three of said toned images in registration, a heating element for contacting said three toned images in registration on said intermediate transfer member and to apply an electrical bias to repel said toned images in registration while having an elevated surface temperature of at least 85 degrees C. to coalesce said three toned images in registration, said heating element not applying an elevated temperature to coalesce said toned images until after the third image of said three images in registration is received on said intermediate transfer member, and a transfer station to transfer said images coalesced by said heating element with pressure to paper of other substrate.

2. The imaging apparatus as in claim 1 in which said means to tone applies a liquid toner to said chargeable roller.

3. The imaging apparatus as in claim 2 in which said elevated temperature is in a range of 85 degrees to about 120 degrees C.

4. The imaging apparatus as in claim 1 in which said elevated temperature is in the range of about 85 degrees to about 120 degrees C.

5. The imaging apparatus as in claim 3 in which the surface of said heating element to contact said toned image is a low surface energy fluorocarbon resin having a conductive filler.

6. The imaging apparatus as in claim 5 in which said heating element through which said bias is applied has electrical resistivity of less than 1E11 ohm-cm.

7. The imaging apparatus as in claim 1 in which said heating element through which said bias is applied has electrical resistivity of less than 1E11 ohm-cm.

8. The imaging apparatus as in claim 3 in which said heating element through which said bias is applied has electrical resistivity of less than 1E11 ohm-cm.

9. The imaging apparatus as in claim 4 in which said heating element through which said bias has electrical resistivity of less than 1E11 ohm-cm.

10. The imaging apparatus as in claim 4 in which said heating element through which said bias has electrical resistivity of less than 1E11 ohm-cm.

* * * * *